US005342550A

United States Patent [19]

Burke et al.

[11] Patent Number: 5,342,550

[45] Date of Patent: Aug. 30, 1994

[54] SOLID DELIVERY SYSTEMS FOR TOILET TANKS, URINALS AND CONDENSATE WATER

[75] Inventors: John J. Burke, Farmington Hills; Joanne P. MacDonald, Plymouth, both of Mich.

[73] Assignee: BASF Corp., Parsippany, N.J.

[21] Appl. No.: 852,467

[22] Filed: Mar. 17, 1992

[51] Int. Cl.[5] ..... C11D 1/68; C11D 1/70; C11D 3/32; C11D 3/37

[52] U.S. Cl. ..... 252/548; 252/153; 252/156; 252/174.21; 252/174.22; 252/174

[58] Field of Search ..... 252/153, 156, 174.21, 252/174.22, 548, 174

[56] References Cited

U.S. PATENT DOCUMENTS 4,043,931 8/1977 Jeffrey et al. ..... 252/93
4,269,723 5/1981 Barford et al. ..... 252/106
4,722,802 2/1988 Hutchings et al. ..... 252/174
4,820,449 4/1989 Menke et al. ..... 252/544
4,911,858 3/1990 Bunczk et al. ..... 252/106
4,911,859 3/1990 Bunczk et al. ..... 252/106

FOREIGN PATENT DOCUMENTS 62-197494 2/1986 Japan ..... 252/174.22

OTHER PUBLICATIONS

English translation of JP 62-197494 Sep. 1987.

*Primary Examiner*—Paul Lieberman
*Assistant Examiner*—Erin Higgins

[57] ABSTRACT

A solid block, controlled release composition suitable for use in toilet tanks, urinals and other water systems has an alkanolamide, surfactant and polyethylene glycol with a molecular weight of about 1450 to about 8000.

6 Claims, No Drawings

SOLID DELIVERY SYSTEMS FOR TOILET TANKS, URINALS AND CONDENSATE WATER

FIELD OF THE INVENTION

The present invention relates to solid delivery systems that are designed to dissolve when in contact with water, thereby releasing desirable functional ingredients. More specifically, the present invention relates to solid, long-lasting compositions for use in toilet or lavatory tanks, bowls, or flush-water cisterns, as well as in other water-containing reservoirs, including trough water collected as condensate or cooling water for air conditioners.

BACKGROUND OF THE INVENTION

Solid lavatory or urinal cleansing compositions are commonly utilized today to clean, deodorize and disinfect toilet water and toilet fixtures. These compositions are typically shaped in the form of "blocks" or "cakes" and are placed by the user in the toilet tank or bowl, or in urinals. The blocks are then designed to slowly dissolve and thereby release part of their active composition over time. It is this time-release attribute which many have found to be invaluable in dispensing functional agents to the water. In many instances, the action of flushing also serves to further dispense the active ingredients.

Solid forms of lavatory cleansing compositions seem to have acquired broader consumer appeal over a diverse array of other product forms such as liquids, powders, and the like. One attribute is their ease of packaging, shipping and handling. Another is their ability to constantly deliver functional material over a specific time period.

Another example of the utility of solid delivery systems is in the microbiostatic or microbicidal treatment of trough water collected as condensate or cooling water for industrial air conditioners. Effective and convenient treatment of the water can be achieved through the placement in the water of a slow dissolving block containing an antimicrobial active ingredient such as a quaternary halide or phenolic structure conventionally noted for their ability to control microorganisms.

Long-chain cellulosic polymers have been used as a major solid component to control dissolution and release of the active ingredients into the pooled water. For example, Barford et al., U.S. Pat. No. 4,269,723 teaches the use of water soluble, water dispersable clays and cellulosics to retard dissolution. Ziek et al., U.S. Pat. No. 4,722,802, also relates to the use of hydrated cellulosics to retard dissolution. In Ziek et al. the advantages of curing the resultant block are also discussed.

Similarly, Bunczak et al., U.S. Pat. Nos. 4,911,858 and 4,911,859, also relate to the use of very high molecular weight polyethylene oxide polymers together with guar gum and calcium salt to form a gelatin matrix that slows dissolution of the solid system. In the '859 patent, this technology is further utilized to deliver iodophor for intended microbial control.

Menke et al., U.S. Pat. No. 4,820,449, relates to the combination of monoalkyl sulfates, fatty acid mono- and di-alkanolamides and inorganic salts for acceptable longevity. Jeffrey et al. in U.S. Pat. No. 4,043,931 seek longevity through the use of mono- or di-alkanolamides of various aliphatic chain lengths and ethylene oxide/propylene oxide block copolymer surfactants of unspecified proportion of the monomer ratio.

There presently exists a need in the art for a solid block, controlled release delivery system without high molecular weight cellulosics, clays and gums, which does not require a special curing process, or very insoluble calcium salts, or very high molecular weight polyethylene oxide polymers, e.g. polyethylene glycols of molecular weight of 250,000 or much higher.

OBJECTS OF THE INVENTIONS

It is therefore an object of the present invention to provide a long-lasting, solid block controlled release delivery system for use in toilet or lavatory tanks, bowls, or flush-water cisterns, as well as in other water-containing reservoirs, including trough water collected as condensate or cooling water for air conditioners.

It is a further object of the present invention to provide solid block delivery systems without high molecular weight polyethylene glycols.

Another object of the present invention is to provide solid block systems without very high molecular weight cellulosics, clays and gums.

A still further object of the invention is to have improved solid block delivery systems without very insoluble calcium salts.

Another object is to have solid block compositions which do not require an expensive and time-consuming curing process.

It is also an object of the present invention to provide for the use of solid block delivery systems in water-containing reservoirs, including toilets, lavatories, urinals and other systems in which treatment of water is desired.

SUMMARY OF THE INVENTION

These and other objects of the invention are achieved by providing a solid block, controlled release composition which comprises at least one fatty alkanolamide, at least one surfactant, and at least one low to medium molecular weight polyethylene glycol having a molecular weight of from about 1450 to about 8000. In one embodiment of the invention, the composition will therefore comprise:

a) from about 5 to about 40% by weight of at least one fatty alkanolamide having a carbon chain length of about 9 to about 18;

b) from about 15 to about 60% by weight of at least one surfactant selected from the group consisting of:

i) oxyalkylated primary aliphatic alcohols having the formula:

$$CH_3(CH_2)_nO(C_2H_4O)_mH$$

wherein n is an alkyl chain whose length is from about 15 to about 17 carbon atoms and m is a number from about 27 to about 55, ii) block copolymer surfactants of the formula:

$$HO(CH_2CH_2O)_a(\underset{\underset{CH_3}{|}}{C}HCH_2O)_b(CH_2CH_2O)_cH$$

having a molecular weight range of from about 7,700 to about 14,600 and being comprised of from about 70 to about 80 percent by weight oxyethylene wherein a has a value of from about 61 to about 133, b has a value of from about 39 to about 65, and c has a value of from about 61 to about 133, iii) alkyl phenol ethoxylates of the formula

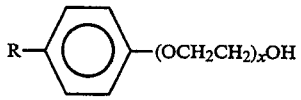

wherein R equals $C_9$ and x is from about 50 to about 100; and c) from about 20 to about 70% by weight of at least one polyethylene glycol selected from the group consisting of polyethylene glycols having a molecular weight within the range of about 1450 to about 8000. Unless otherwise specified herein, the term molecular weight will refer to weight average ($M_W$) molecular weight, and all quantities will be expressed as weight percentages based upon the total weight of the compositions according to the various embodiments of the invention.

It is surprising that low molecular weight polyethylene (PE) glycols may be utilized in the solid block, controlled release composition according to the invention because typically low molecular weight PE glycols do not gel easily, and therefore dissolve very quickly. For this reason, they have frequently been used in pharmaceutical preparations to accelerate the dissolution of slower dissolving ingredients. In the compositions according to the various embodiments of the invention, the low molecular weight PE glycols instead appear to have imparted unexpected longevity and utility to the various components.

Also provided as part of the invention is the use of the compositions according to the various embodiments for the cleansing, deodorizing and disinfecting of toilet and urinal water and fixtures, as well as for the microbicidal and microbiostatic treatment of trough water collected as condensate from industrial air conditioners.

DETAILED DESCRIPTION OF THE PREFERRED EMBODIMENTS

According to the invention, the solid block controlled release composition will comprise at least one fatty alkanolamide, at least one surfactant, and at least one low to medium molecular weight polyethylene glycol having a molecular weight of from about 1450 to about 8000. In one of its more preferred embodiments, the solid block, controlled release composition will comprise about 5 to about 40 percent of at least one fatty alkanolamide, from about 15 to about 60 percent of at least one surfactant and from about 20 to about 70 percent of at least one polyethylene glycol having a molecular weight of from about 1450 to about 8000. In an even more preferred embodiment of the invention, the composition will comprise at least one fatty alkanolamide in an amount of from about 10 to about 25 percent, at least one surfactant in an amount of from about 20 to about 30 percent, and at least one polyethylene glycol in an amount of from about 25 to about 35 percent.

Preferably, the fatty alkanolamide will have a carbon chain length of from about 9 to about 18. More preferably, the fatty alkanolamide will comprise

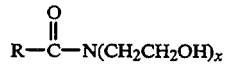

wherein RCO represents the coconut acid radical and R equals $C_{12-14}$ and x equals 1 or 2. This compound may be referred to as cocoalkanolamide.

The preferred surfactants for use with the present invention include i) the oxyalkylated primary aliphatic alcohols having the formula:

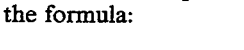

wherein n is an alkyl chain whose length is from about 15 to about 17 carbon atoms and m is a number from about 27 to about 55, ii) the block copolymer surfactants of the formula:

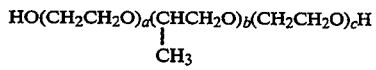

having a molecular weight range of from about 7,700 to about 14,600 and being comprised of from about 70 to about 80 percent by weight oxyethylene wherein a has a value of from about 61 to about 133, b has a value of from about 39 to about 65, and c has a value of from about 61 to about 133, and iii) alkyl phenol ethoxylates of the formula

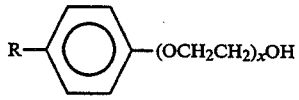

wherein R equals $C_9$ and x is from about 50 to about 100.

More preferably, the surfactants will include the compound having the formula i) above wherein n equals 17 and m equals 27 (sold by BASF Corp. under the trademark PLURAFAC® A38); and the compound of formula i) wherein n equals 17 and m equals 55 (sold by BASF Corp. under the trademark PLURAFAC® A39). Also preferred are the compounds of formula ii) above wherein a equals 100, b equals 65 and c equals 100 (sold by BASF Corp. under the trademark PLURONIC® F127); a equals 133, b equals 50 and c equals 133 (sold by BASF Corp. under the trademark PLURONIC® F108); a equals 118, b equals 45 and c equals 118 (sold by BASF Corp. under the trademark PLURONIC® F98); a equals 103, b equals 39 and c equals 108 (sold by BASF Corp. under the trademark PLURONIC® F88); a equals 61, b equals 40 and c equals 61 (sold by BASF Corp. under the trademark PLURONIC® F87). Also preferred surfactants are the compounds of formula iii) above, wherein R equals $C_9$ and x equals 50 (sold by BASF Corp. under the trademark ICONOL® NP 50); R equals $C_9$ and x equals 70 (sold by BASF Corp. under the trademark ICONOL® NP70); R equals $C_9$ and x equals 100 (sold by BASF Corp. under the trademark ICONOL® NP 100).

Most preferably, the surfactant will be the compounds of formula ii) above wherein a equals 100, b equals 65 and c equals 100 (sold by BASF Corp. under the trademark PLURONIC® F127).

The preferred polyethylene glycol for use in the solid block composition will have a molecular weight of about 8000. Particularly preferred for use with the present invention is the PE glycol marketed by BASF Corp. under the trademark PLURACOL ® E 8000.

It is also desirable that the solid block, controlled release composition according to the invention have one or more fillers or binding agents incorporated therein. These binding agents are typically utilized to mold the composition into blocks or cakes of a suitable size without using excessive amounts of active ingredients. Examples of acceptable binding agents include the water-soluble alkali metal and alkaline earth metal salts. Among these, the sulfates, carbonates, bicarbonates and chlorides are preferred. Particularly preferred is sodium carbonate or sodium bicarbonate or sodium chloride, and most preferred is sodium sulfate. The binding agent is present in the composition in an amount of from about 20 to about 50 percent by weight, preferably from about 20 to about 30 percent, and most preferably about 25 percent.

One especially preferred embodiment of the invention will therefore comprise about 25 percent one or more fillers or binding agents, most preferably sodium sulfate, as well as about 13 percent of alkanolamide, about 25 percent of surfactant, and about 28 percent of polyethylene glycol.

The composition according to the invention will also preferably comprise one or more additional ingredients such as, for example, cleaning agents, deodorizers or perfumes, bactericides, bacteriostat, hard water film inhibitors, stain inhibitors and dyes. These additional ingredients will typically be present in the composition in total amounts of from about 0.05% to about 20% by weight of the composition.

Cleaning agents may include any of the solid bleaching preparations known to those in the art. Deodorizers or perfumes impart an acceptable odor to the composition and subsequently to the treated water, and may include essential oils and pine extracts, terpinolenes, bornyl acetate, diphenyl oxide, ortho phenyl phenol, paradichlorobenzene, as well as others known in the art.

Bactericides and bacteriostats are those agents which inhibit and kill germs and other undesirable organisms. These may include, for example, formaldehyde release agents, chlorinated phenols and chlorine release agents such as sodium dichloroisocyanate, as well as others known to those skilled in the art.

Hard water inhibitors and stain inhibitors may include polymers such as sodium polyacrylates or copolymers of maleic and acrylic acids, as well as chelants such as EDTA, NTA and the like.

Dyes are those ingredients which typically impart a pleasing color to the composition, and may include any of the known blue, green or violet dyes.

The solid block, controlled release compositions according to the various embodiments of the invention may be prepared by any known process, such as casting, molding or tablet compression. Preferably, the compositions are prepared according to the "melting" process. According to this method, the various ingredients are placed in a beaker or other suitable container, and are then heated to melting (approximately 70 degrees C.), and mixed. The melted constituents are then poured into molds and allowed to cool to room temperature (approximately 25 degrees C.). Once cooled, the compositions are then separated from the molds.

The various embodiments of the invention may be molded into numerous shapes and sizes, but it is preferable that the compositions take the shape of blocks or cubes, or tablets. It is also preferable that the blocks range in weight from about 25 to about 100 grams.

Dissolution rates for the block compositions according to the various embodiments of the invention range from about 2 hours to about 15 hours or longer. It is preferable that the dissolution rate be at least about 7 hours, more preferably, at least about 15 hours. The dissolution rate is measured by placing a 0.50 gram sample of the solid composition in 25 degree C., 100 ppm tap water in a suitable apparatus which allows the water to pass over the solid composition. The water is run continuously until the sample is visually ascertained to be fully dissolved. The length of time required for complete dissolution is thus the dissolution rate or time. Larger size samples will have longer dissolution times. On average, dissolution times will be from about 4 hours to about 30 hours or longer for each one (1) gram of solid block, controlled release composition according to the invention.

The following example is provided to illustrate the invention, and should not be construed as limiting the scope thereof:

EXAMPLE

Two samples were prepared according to the melting process set forth above. These samples were labeled Sample A and Sample E and had the following constituents by weight:

| | Sample A grams | Sample E grams |
|---|---|---|
| PLURONIC ® F 127 | 18.25 | 25 |
| PLURACOL ® E 8000 | 20.44 | 28 |
| Coco MEA | 36.50 | 13 |
| Sodium Sulfate | 18.25 | 25 |
| Perfume | 2.92 | 4 |
| Dye (liquid) | 3.65 | 5 |

Next, the efficacy of 0.50 grams of the Samples A and E was compared with 0.50 grams of three samples of commercial products available on the market. Sample B was a product of the Drackett Company and marketed under the trademark VANISH DROP IN. Sample C was a product of Kiwi Brands, Inc. and sold under the trademark BLOO. Sample D was a product of the Dial Corporation and sold under the trademark SNO-DROPS. The dissolution rates for each of Samples A through E were measured according to the method heretofore set forth. The dissolution rates for Samples A, B, C, D and E were as follows:

| | |
|---|---|
| SAMPLE A | 15 HOURS |
| SAMPLE B | 3 HOURS |
| SAMPLE C | 2 HOURS |
| SAMPLE D | 5 HOURS |
| SAMPLE E | 6 HOURS |

The compositions according to the various embodiments of the invention will find quick application in the cleansing, deodorizing and disinfecting of toilet and flush water, as well as toilet and urinal fixtures in contact with water. The compositions may be made into various shapes and sizes as heretofore set forth, such as for example, cubes or tablets, and are placed so as to be in substantial contact with toilet or flush water. Complete immersion of the compositions is certainly within the scope of the invention.

The compositions of the invention may also be utilized in the microbiostatic or microbicidal treatment of trough water collected as condensate or cooling water for industrial air conditioners. Treatment is effected by placing one or more of the compositions in suitable shape in contact with the trough water. Once fully dissolved, the treatment block(s) may then be replaced with new, fresh block(s).

While the invention has been described in each of its various embodiments, it is to be expected that certain modifications may occur to those skilled in the art without departing from the true spirit and scope of the invention as set forth herein and in the accompanying claims.

What is claimed is:

1. A solid block, controlled release composition, consisting essentially of:

a) from about 5 to about 40% by weight of a fatty alkanolamide having a carbon chain length of about 9 to about 18;

b) from about 15 to about 60% by weight of at least one surfactant selected from the group consisting of:

i) oxyalkylated primary aliphatic alcohols having the formula:

$$CH_3(CH_2)_nO(C_2H_4O)_mH$$

wherein m is an integer which results in an alkyl chain whose length is from about 15 to about 17 carbon atoms and m is a number from about 27 to about 55, ii) block copolymer surfactants of the formula:

$$HO(CH_2CH_2O)_a(\underset{\underset{CH_3}{|}}{CH}CH_2O)_b(CH_2CH_2O)_cH$$

having a molecular weight range of from about 7,700 to about 14,600 and being comprised of from about 70 to about 80 percent by weight oxyethylene wherein a has a value of from about 61 to about 133, b has a value of from about 39 to about 65, and c has a value of from about 61 to about 133, and iii) alkyl phenol ethoxylates of the formula:

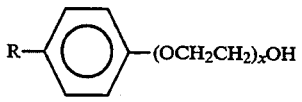

wherein R equals $C_9$ and x is from about 50 to about 100;

c) from about 20 to about 70% by weight of at least one polyethylene glycol selected from the group consisting of polyethylene glycols having a molecular weight within the range of from about 1450 to about 8000; and d) from about 20 to about 50 percent of at least one binding agent.

2. The composition as claimed in claim 1, consisting essentially of:

a) about 10 to about 20% by weight of said fatty alkanolamide;

b) about 20 to about 30% by weight of said surfactant;

c) about 25 to about 35% by weight of said polyethylene glycol; and d) about 20 to about 30% of said binding agent.

3. The composition as claimed in claim 2, wherein said alkanolamide is:

$$R-\overset{\overset{O}{\|}}{C}-\overset{\overset{H_{(2-x)}}{|}}{N}(CH_2CH_2OH)_x$$

wherein RCO represents the coconut acid radical and R equals $C_{12-14}$ and x equals 1 or 2, and said surfactant is selected from the group consisting of the compounds having the formula i) wherein n equals 17 and m equals 27 and the compound of formula i) wherein n equals 17 and m equals 55; the compounds of formula ii) wherein a equals 100, b equals 65 and c equals 100, a equals 133, b equals 50 and c equals 133, a equals 118, b equals 45 and c equals 118, a equals 103, b equals 39 and c equals 103, a equals 61, b equals 40 and c equals 61; and the compounds of formula iii) wherein R equals $C_9$ and x equals 50, R equals $C_9$ and x equals 70, R equals $C_9$ and x equals 100; and said polyethylene glycol has a molecular weight of about 8000.

4. The composition as claimed in claim 3, wherein said fatty alkanolamide is cocoalkanolamide, said surfactant is the compounds of formula ii) wherein a equals 100, b equals 65 and c equals 100, and said polyethylene glycol has a molecular weight of about 8000.

5. The composition as claimed in claim 4, wherein said composition has a dissolution rate for complete dissolution of at least about 6 hours per 0.50 grams of said composition.

6. The composition as claimed in claim 5, wherein said composition has a dissolution rate for complete dissolution of at least about 15 hours per 0.50 grams of said composition.

* * * * *